US005181788A

United States Patent [19]

Norman, Jr. et al.

[11] Patent Number: 5,181,788

[45] Date of Patent: Jan. 26, 1993

[54] RIBBON SAVING CONTROL MECHANISM

[75] Inventors: Thomas J. Norman, Jr., Richardson; James R. Ingram, Jr., Dallas; Joel Y. Lin, Denton, all of Tex.

[73] Assignee: BanTec, Inc., Dallas, Tex.

[21] Appl. No.: 657,247

[22] Filed: Feb. 15, 1991

Related U.S. Application Data

[63] Continuation of Ser. No. 338,868, Apr. 17, 1989, abandoned, which is a continuation of Ser. No. 20,444, Mar. 2, 1987, abandoned.

[51] Int. Cl.[5] ..... B41J 33/51

[52] U.S. Cl. ..... 400/232; 400/225

[58] Field of Search ..... 400/231-233, 400/218, 223, 224, 225, 227; 101/336

[56] References Cited

U.S. PATENT DOCUMENTS 3,730,082 5/1973 Perry ..... 101/336

4,492,161 1/1985 Johnson ..... 101/93

FOREIGN PATENT DOCUMENTS 67494 4/1983 Japan ..... 400/218

207276 11/1984 Japan ..... 400/223

*Primary Examiner*—David A. Wiecking

*Assistant Examiner*—Steven S. Kelley

[57] ABSTRACT

A ribbon control mechanism for a serial encoding device is provided to conserve the usage of single-strike ribbon consumed during printing. The mechanism includes a ribbon transport mechanism and means for signaling the transport mechanism to reverse the ribbon between documents to position the ribbon for printing in unspent ribbon.

2 Claims, 5 Drawing Sheets

RIBBON SAVING CONTROL MECHANISM

CROSS-REFERENCE TO RELATED APPLICATION

This is a continuation of prior co-pending application Ser. No. 07/338,868 filed on Apr. 17, 1989, which is a continuation of prior co-pending application Ser. No. 07/020,444, filed Mar. 2, 1987, both now abandoned.

TECHNICAL FIELD

This application relates to ribbon control mechanisms for document encoders and more particularly to a ribbon control mechanism including reversible drive apparatus for a document encoder using a single-strike ribbon.

BACKGROUND ART

Document encoders which are well known in the art typically fall into two general categories. The first category of encoders includes those encoders which utilize a step function to position the document to be encoded at a particular point. Such encoders function in a manner typically associated with typewriters or other mechanical printers and are not generally compatible with high speed document processors.

A second category of document encoders which is capable of encoding continuously moving documents is nonetheless incompatible with modern financial document processors. The second category of encoders includes laser printers and ink jet printers. While these two types of encoders are capable of encoding a moving document, the magnetic ink required for use with financial documents such as checks is incompatible with current ink jet technology.

It is known in the art to print across a document in horizontal motion, sometimes referred to as horizontal "on the fly" printing. Printing "on the fly" may be accomplished by providing a number of fixed hammers and a corresponding set of fixed character dies, through which a document and an ink ribbon are transported in unison while the hammers are activated to print a sequence of characters on the document. The printing of documents "on the fly" has been used with great success in the encoding of financial documents, such as checks, in high speed encoding systems such as the one shown in U.S. Pat. No. 4,492,161 issued to the assignee of the present application, the disclosure of which is incorporated herein by reference.

In the prior art "on the fly" financial document encoders, magnetic ink ribbons are used to encode the documents with magnetic characters. Such magnetic ink ribbons are typically single-strike ribbons, that is, the magnetic ink associated with each character is totally removed from the ribbon during the printing of that character, and the same section of ribbon cannot be used a second time. In the prior art encoders, the ribbon control mechanism provides for transport of the ribbon in one direction only, with the ribbon transport being activated to transport the ribbon in unison with a financial document in the apparatus by the sensing of the leading edge of the document just before the document enters the print zone between the hammers and die. Specifically, an optical sensor is provided to sense the leading edge of the document and is located directly adjacent the entrance to the print zone. The ribbon transport is then deactivated in the prior art mechanism when the encoding process on a document is finished.

The prior art ribbon transport is deactivated once the last character in a series of characters, in time, is struck. It will be understood from the disclosure of the assignee's aforementioned prior patent that the character physically located last in a series of characters on a document is not necessarily the last character to be struck in time. The chronological sequence of character strikes will be dependent not only on the position of the character on the document but also the position of the character on the die set. As a result, when the last character is struck, a gap of unspent ribbon remains in the die between the entrance to the print zone and the last character. This portion of unspent ribbon is not used in printing the next document to enter the print zone, because the ribbon transport will be activated as the next document enters the print zone.

The gaps of unspent ribbon between spent portions represents a substantial wastage of ribbon. At a typical wastage rate of 50%, the typical customer encoding one million documents per month could realize a substantial savings if the amount of ribbon wastage could be controlled, thus, a need presently exists for a ribbon control mechanism that eliminates the gaps of unspent ribbon in an "on the fly" printing apparatus.

SUMMARY OF THE INVENTION

It is therefore an object of the present invention to provide an improved document encoder.

It is another object of the present invention to provide an improved document encoder that is capable of encoding continuously moving documents.

It is yet another object of the present invention to provide an improved document encoder that is capable of encoding continuously moving documents utilizing magnetic ink.

The foregoing objects are achieved as is now described. Documents are transported between a plurality of fixed dies and a plurality of electronically controlled hammers. A magnetic ink bearing ribbon is interposed between the documents and the fixed dies and is transported at the same velocity as the documents. As the documents traverse the plurality of fixed dies, the electronically controlled hammers are cycled, in a selected sequence and at selected positions. In those applications in which the cycle time of the electronically controlled hammer is too slow to allow identical encoding in adjacent positions, a second plurality of fixed dies and associated electronically controlled hammers may be located adjacent to the first plurality or interspersed among the first plurality of fixed dies.

The present invention solves the problem of wasted unspent ribbon by providing a ribbon control mechanism for reversing the ribbon between documents to eliminate gaps of unspent ribbon between spent portions. The portion of the ribbon that is unspent after an encoding operation is salvaged by backing up the ribbon to a point where only spent ribbon is in the print zone and the unspent portion begins at the entrance to the print zone. Because a variable amount of unspent ribbon is generated depending on the sequence of characters, in the preferred embodiment the control computer is used to calculate the exact amount that needs to be reversed. In a simplified embodiment, the ribbon is continued to be fed with the document until the last character of the last printed field exits the print zone. Unspent ribbon then exists in the print zone for the entire length of the die. The ribbon is then reversed for the length of the die. Ribbon transport apparatus capable of rapidly accelerating the ribbon in both forward and reverse directions is provided by using vacuum columns in the ribbon supply and takeup mechanisms. A capstan moves the ribbon in the print zone between the vacuum columns.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

Figures 4, 5, 6, 7A, 7B:
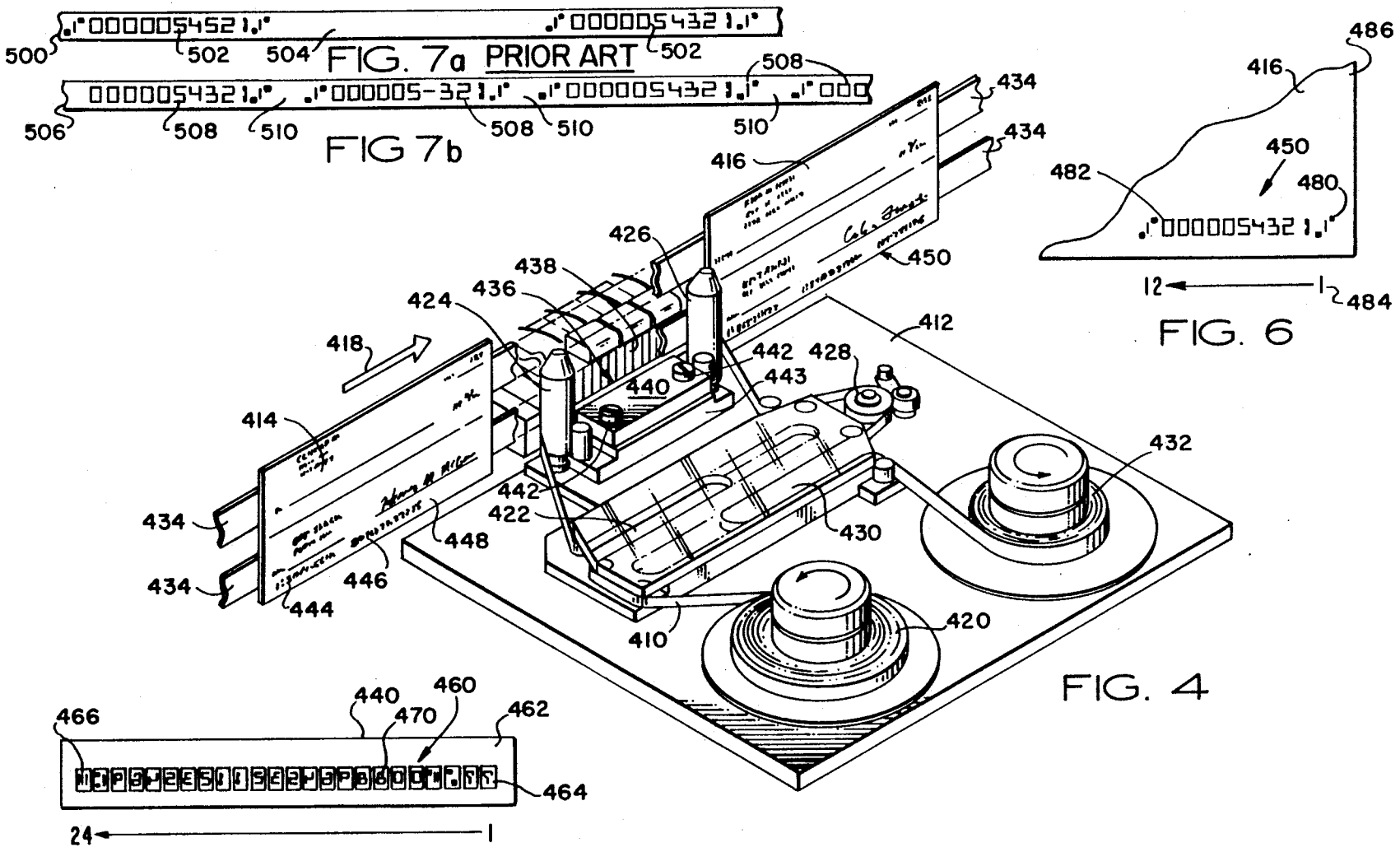
FIG. 7a PRIOR ART

FIG. *3a* depicts a block diagram of the encoder of a document processing system incorporating the present invention;

FIG. *3b* depicts a diagrammatic view of an encoder apparatus of the type to be improved by the present invention;

FIG. 4 is a diagrammatic view of improved encoder apparatus incorporating the present invention;

FIG. 5 is an elevation view of a die set used in conjunction with the invention;

FIG. 6 is a partial view of a corner of a document with MICR coding; and

FIGS. *7a* and *7b* are views of spent ribbons illustrating the advantages of the present invention.

DETAILED DESCRIPTION

Figure 1A:
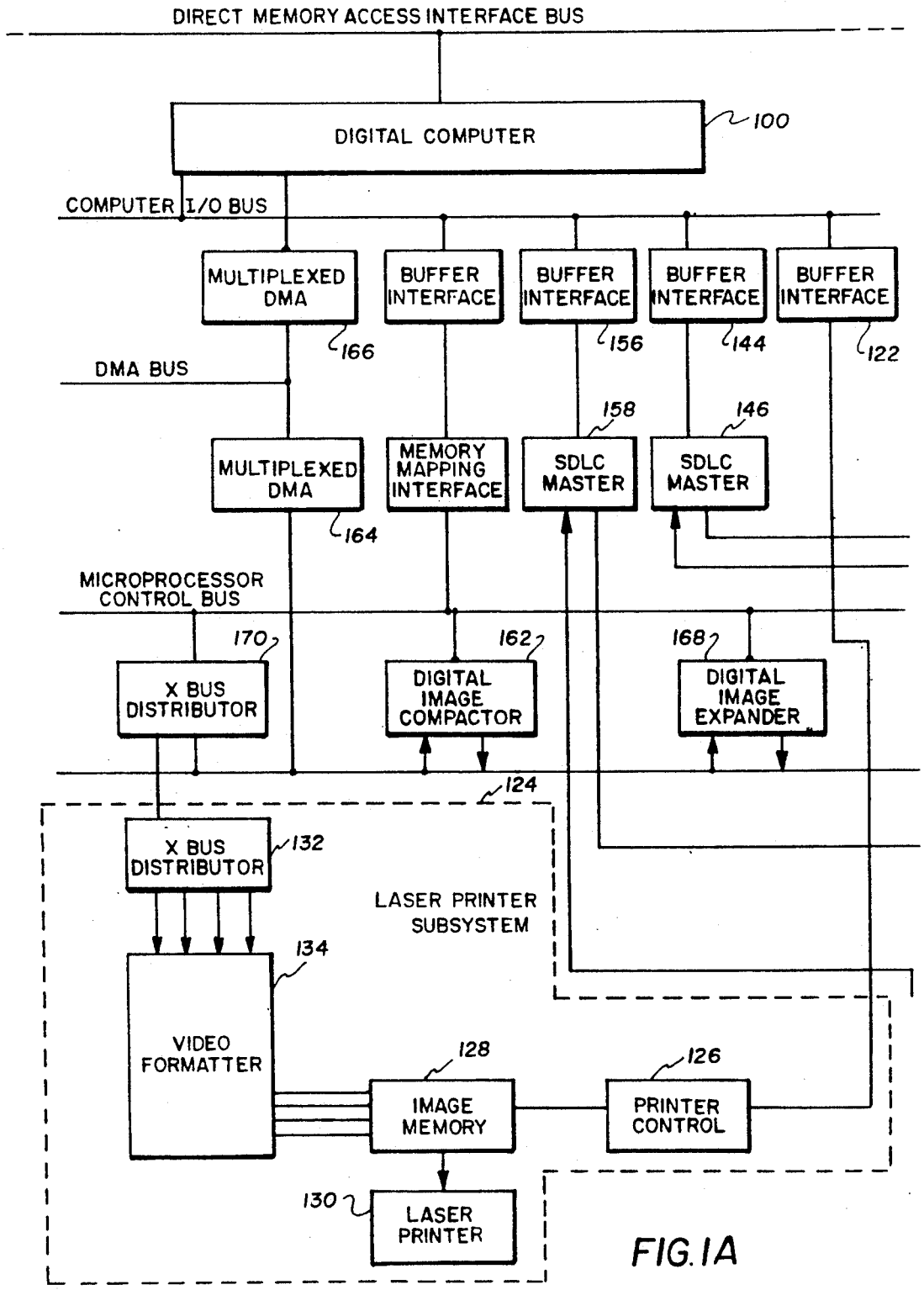
FIGS. 1A and 1B form a general block diagram of a document processing system incorporating the present invention.
Figure 1B:
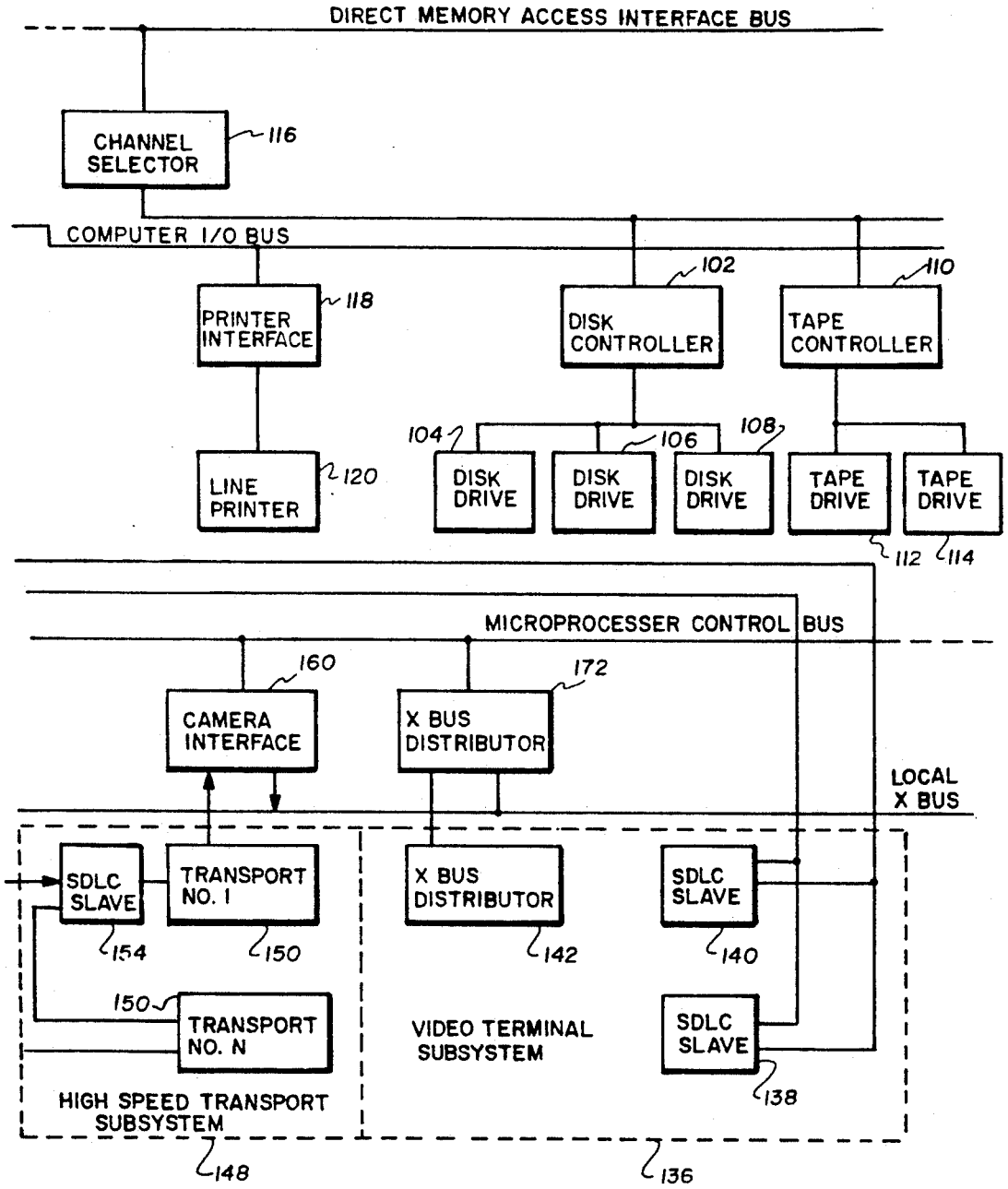

Referring to FIGS. 1A and 1B, there is depicted a general block diagram of the various subsystems comprising a document processing system.

The document processing system is controlled by digital computer 100. Digital computer 100 coordinates the storage and retrieval of digitized document images and associated data which are stored, in the disclosed embodiment, in magnetic disk storage. Disk controller 102 controls the actual access of digitized document images via disk drives 104, 106, and 108. Additional data, accounting information or program data may be accessed by digital computer 100 through tape controller 110 which controls magnetic tape drives 112 and 114. It will be appreciated by those skilled in the art that disk controller 102 and tape controller 110 may control an increased or decreased number of disk or tape drives, as a matter of design choice. Digital computer 100 may selectively access either magnetic disk storage or magnetic tape storage through channel selector 116.

Digital computer 100, in the embodiment disclosed, interfaces with a local operator via the computer I/O bus and printer interface 118. Printer interface 118 controls line printer 120. In alternate modes of operation wherein remote communication with digital computer 100 is desired, a modem and appropriate interface circuitry may be utilized.

Digital computer 100 also controls the operation of laser printer subsystems 124, through laser printer interface 122. Laser printer subsystem 124 is utilized to provide hard copy of selected digital images and may be utilized to generate account statements, billing statements, or other correspondence comprising any combination of alphanumeric characters and images.

Video terminal subsystem 136 is utilized in the document processing system to provide a real time, controllable video display of selected documents and alphanumeric information. The display is utilized to facilitate processing of information on each document. Digital computer 100 controls the operation of video terminal subsystem 136 through buffer interface 144 and synchronous data link control master 146. A plurality of video display terminals may be utilized with each SDLC master.

High speed transport subsystem 148 is utilized to transport individual documents through image capture stations, machine readers, encoders and sorters. A plurality of high speed transports may be utilized within each document processing system, thereby increasing the capacity of an individual system. High speed transport system 148 is controlled utilizing buffer interface 156 and synchronous data link control master 158. High speed transport system 148 will be explained in greater detail with respect to FIG. 2.

Digital image data obtained from the digital camera or cameras installed in each high speed transport is transferred to camera interface 160. Camera interface 160 is utilized to couple the image data to digital image compactor 162. Digital image compactor 162 is utilized to remove any redundancies contained in a selected image and to encode the remaining data. The thus compacted digital image will require substantially less storage space in the document processing system. The compacted image data may be transferred to storage via multiplexed direct memory access 164 and multiplexed direct memory access 166. Two direct memory systems are utilized in order to provide compatible interfaces between the local X bus and the direct memory access interface bus of digital computer 100.

Retrieval and display of a compacted digital image may take place in several ways. A compacted image is transferred to the local X bus via direct memory access 164 and direct memory access 166. The compacted image is applied to digital image expander 168. The redundancies present in the original image are restored and the subsequent image is transferred via X bus distributor 170 or X bus distributor 172 to either laser printer subsystem 124 or video terminal subsystem 136 for reproduction of a hard copy or an electronic image.

Digital Computer

The document processing system utilizes a digital computer 100, FIG. 1A, to control the operation of the system and coordinate the storage and retrieval of document images. In one embodiment digital computer 100 may be a Series 3200 minicomputer, manufactured by the Perkin-Elmer Computer Systems Division of Oceanport, N.J.

The Model 3242 minicomputer utilizes 32-bit architecture and a 32-bit operating system. The main memory storage contains 1536 kilobytes of 150 nanosecond MOS memory. Supplementing the computer's main memory store are disc drives 104, 106 and 108 (FIG. 1B), Model 9775 manufactured by Control Data Corporation of Minneapolis, Minn., and tape drives 112 and 114 (FIG. 1B), Model TPAC 4516, manufactured by Perkin-Elmer of Oceanport, N.J.

Digital computer 100 can also include a rechargeable battery backup system (not shown) to sustain the main memory in the event of a power failure. Digital computer 100 can utilize a battery rated at 320 megabyte-minutes, which is capable of maintaining the memory integrity of 16 megabytes for twenty minutes.

Document Transport

Figure 2:
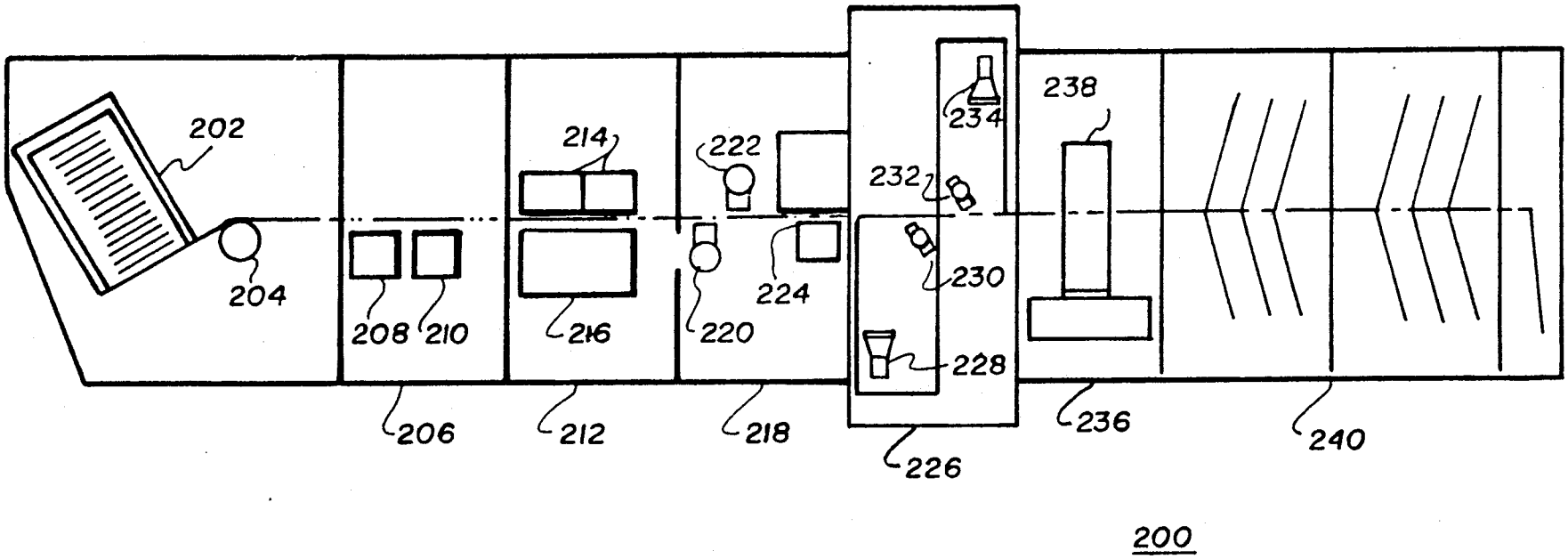
FIG. 2 depicts a diagrammatic view of the document transport of a document processing system incorporating the present invention.

Referring now to FIG. 2, there is depicted a diagrammatic plan view of document transport 200. Document transport 200 is a specially built transport which may be modified to include additional equipment or to exclude undesired capabilities. The transport constructed and depicted in FIG. 2 utilizes high speed endless belts which are driven by pinch rollers in the manner well known in the art. The pinch rollers are driven by synchronous AC motors at a nominal speed of 52 inches per second in the disclosed embodiment. Sections of the transport may be driven at different speeds in a manner described below.

Documents are loaded into document transport 200 by means of document hopper 202. Single documents are loaded from document hopper 202 via feed drum 204. The documents are then passed along document transport 200 between rollers and the endless belts (not shown). The first section of document transport 200, reader section 206, includes an optional character reader 208 and a magnetic ink character reader 210.

The next section of document transport 200 is encoder section 212. Encoder section 212 includes hammer bank assembly 214 and die and ribbon assembly 216 and is utilized to encode selected documents with selectable indicia, while the document is traversing document transport 200. The operation of the encoder section will be explained in greater detail with reference to FIGS. 3*a*, 3*b*, 4, 5, 6, 7*a* and 7*b*.

Section 218 of document transport 200 is the endorser section. Endorser section 218 contains ink jet printers 220 and 222 and endorser 224. Ink jet printers 220 and 222 are standard state of the art ink jet printers that may be utilized, in the disclosed embodiment, to print selected indicia upon each document which passes through document transport 200. The selected indicia may be utilized to assist in audit trail functions or in any other function desired. Endorser 224 is utilized to endorse documents such as checks.

The next section in document transport 200 through which each document is transported is camera section 226. Camera section 226 contains, in the embodiment disclosed, two digital video cameras, 228 and 234 and two illumination sources, 230 and 232. Each document which passes through camera section 226 is scanned on both sides utilizing video cameras 228 and 234.

The penultimate section of document transport 200, microfilm section 236, contains a microprocessor controlled microfilm recorder 238. Microfilm recorder 238 is utilized to provide hard copy of selected documents which have been processed by the system of the invention.

The final section of document transport 200 is stacker section 240. Stacker section 240, in any manner well known in the art, sorts the documents processed through document transport 200 into one of several pockets. The number of pockets is, of course, a design choice wholly dependent upon the application desired.

As those skilled in the art will appreciate, the modularity of design employed in document transport 200 will allow great flexibility in many applications. Whole sections of document transport 200 may be deleted or rearranged to permit a wide variety of custom applications. Further, the number and type of devices within each module may be increased or decreased as a matter of design choice.

Encoder

Figure 3A:
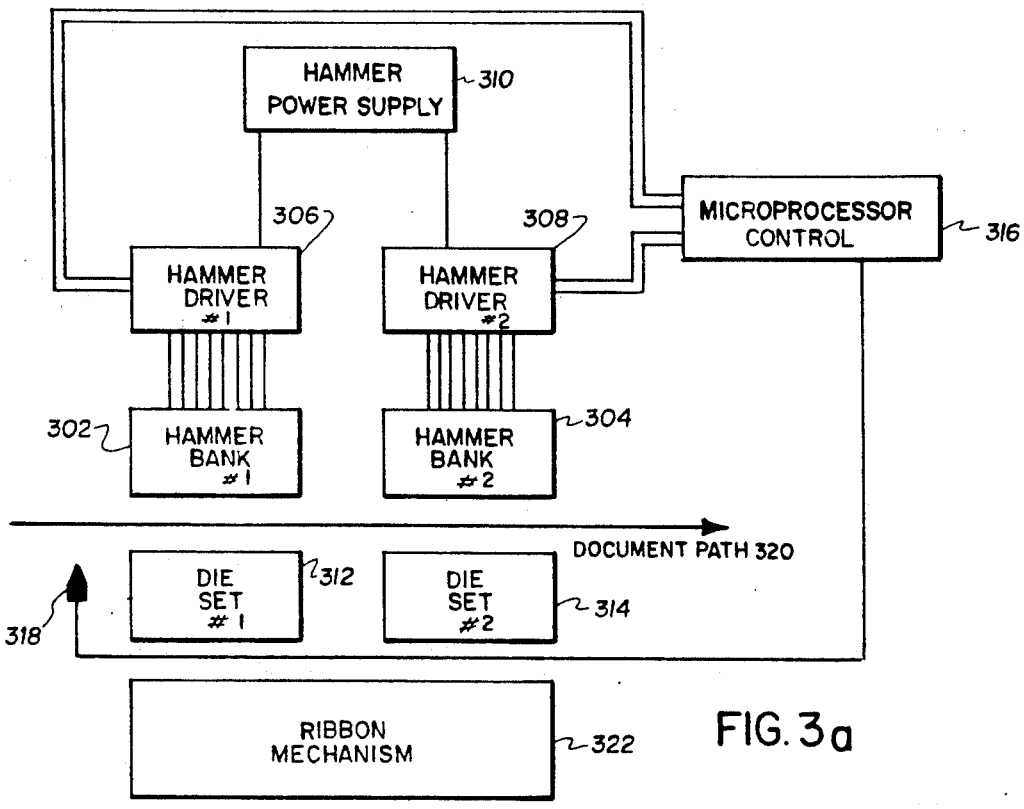

With reference now to FIG. 3*a*, there is depicted a schematic view of an encoder 300. An important feature of the system is the ability to encode continuously moving documents. Document encoder 300 is capable of encoding documents which are continuously moving at the rate of the overall document processing system hereof.

Document encoder 300 utilizes, for example, two identical electromagnetic hammer banks, hammer bank 302 and hammer bank 304. It will be apparent, however, upon reference to the foregoing explanation, that a fewer or greater number of hammer banks may be utilized in systems wherein slower or faster transport speeds are desired. Hammer banks 302 and 304 are electromagnetic hammers such as part no. CCE-05-306 manufactured by Dataproducts, Woodland Hills, Calif. Each hammer bank is controlled by a hammer driver. In the disclosed embodiment, hammer driver 306 controls hammer bank 302 and hammer driver 308 controls hammer bank 304. Hammer power supply 310 provides operating power for all hammer drivers and hammer banks.

Positioned opposite each hammer bank is an appropriately encoded die. The selection of characters utilized in a particular application is strictly a design choice and may include OCR characters. MICR characters or any other desired character pattern. The illustrated embodiment includes two substantially identical die sets, die set 312 and die set 314. However, as a matter of design choice, a single die set may be utilized. Also included in the illustrated embodiment is microprocessor control 316, which provides control signals to hammer drivers 306 and 308 in response to signals from optical sensor 318. Optical sensor 318 is utilized to detect the presence of a document along document path 320.

Figure 3B:
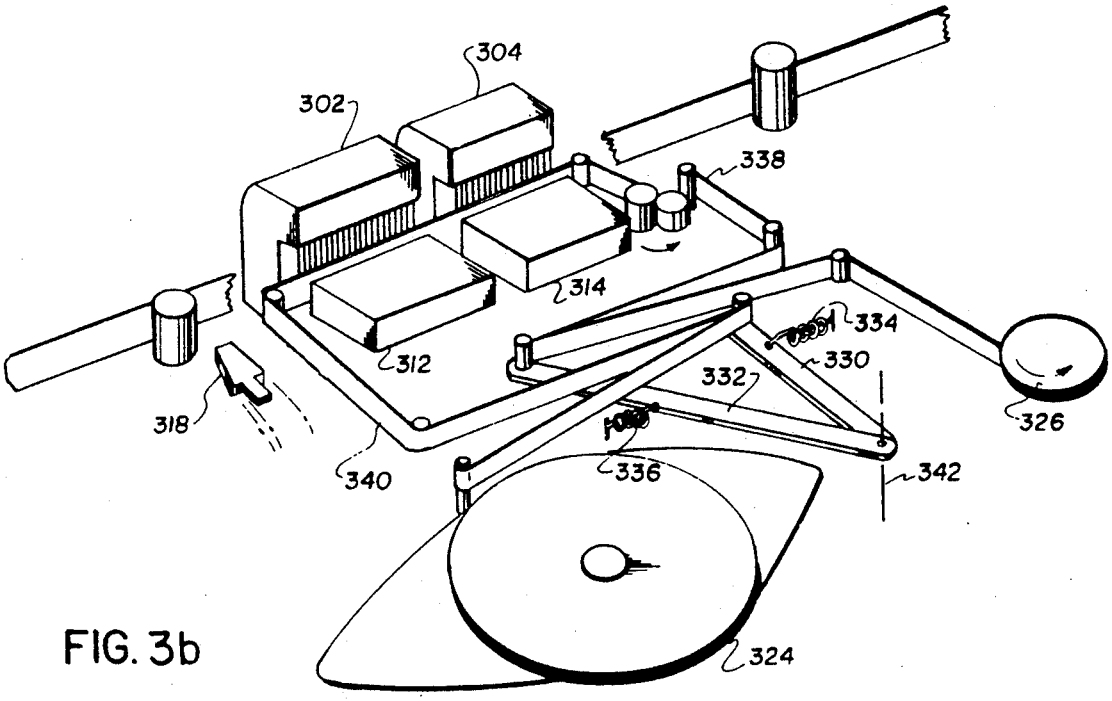

FIG. 3*b* depicts a partially diagrammatic view of the major components of document encoder 300. As explained above, hammer banks 302 and 304 selectively strike portions of die sets 312 and 314, upon receipt of control signals generated by a microprocessor control 316 (see FIG. 3*a*), in conjunction with an item presence signal generated by optical sensor 318.

Ribbon mechanism 322 (FIG. 3*a*) is shown in greater detail in FIG. 3*b* and includes a ribbon supply reel 324, ribbon takeup reel 326, ribbon tensioning arms 330 and 332 and ribbon capstan 338. Ribbon supply reel 324 provides a fresh supply of magnetic ink ribbon 340. Such magnetic ink ribbons are typically single strike ribbons, that is to say the magnetic ink associated with each character is totally removed from the ribbon during the printing of that character and further attempts to print utilizing the same section of ribbon 340 will result in invalid magnetic signatures. Therefore, it is necessary to advance magnetic ink ribbon 340 after each character is printed, and it is advantageous, from an economy standpoint, to advance ribbon 340 only while a document is present in encoder 300. This is accomplished utilizing ribbon capstan 338 which is electronically controlled by microprocessor control 316 during those periods when a document is detected by optical sensor 318. Ribbon 340 is driven by ribbon capstan 338 at the same speed as documents on the transport. The rapid acceleration of ribbon 340 to transport speed is accomplished without damage to ribbon 340 utilizing ribbon tensioning arms 330 and 332. Ribbon tensioning arms 330 and 332 are pivotally mounted at point 342 and resiliently biased utilizing springs 334 and 336. A rapid acceleration of ribbon 340 is then absorbed by ribbon tensioning arms 330 and 332 until ribbon supply reel 324 and ribbon takeup reel 326 can compensate.

In operation, encoder 300 utilizes two character sets to compensate for the duty cycle of the hammer bank utilized. Each individual hammer within hammer banks 306 and 308 has a duty cycle of approximately 0.004 seconds. Document encoding standards for MICR require individual characters to be encoded approximately one-eight inch apart, one-tenth inch spacing for OCR. At a nominal transport speed of 52 inches per second, a document will travel one-eighth inch in approximately 0.0024 seconds. It should therefore be apparent that with a duty cycle of 0.004 seconds, a single hammer and die combination will be unable to repetitively strike a single character at one-eight inch intervals. Thus, the use of multiple hammers and substantially identical character sets will allow full encoding at the present duty cycle. Consider a possible worse case analysis, a desired encoding of eight consecutive identical characters. Those skilled in the art will appreciate that a single hammer and die will be able to encode alternate digit positions at the stated speed of operation. The second group of hammers and characters allows encoder 300 to fill in the missing digits. More specifically, hammer bank 306 and die set 312 may encode the odd digit positions in a desired field, and hammer bank 308 and die set 314 may encode the even digit positions. Thus, it should be apparent that increased or decreased transport speeds may be accommodated by utilizing a greater or fewer number of hammer banks and die sets, without requiring a faster duty cycle for individual hammers. It should also be apparent that since certain portions of a particular digit field may be encoded by one hammer bank while other positions may be encoded by a second hammer bank, it will be advantageous to maintain ribbon 340 at the same speed as the documents passing through encoder 300. By so doing, the used portions of ribbon 340 associated with a particular character will maintain its relative position directly above that particular character on the document.

Referring now to FIG. 4, an improved ribbon control mechanism incorporating the features of the present invention includes ribbon 410 in encoding mechanism 412 for encoding characters upon documents 414 and 416 transported along a document pathway represented by arrow 418. Ribbon 410 is selectively transported through encoding mechanism 412 by means of a ribbon control mechanism that includes feed reel 420, feed vacuum column 422, guide rollers 424 and 426, capstan 428, takeup vacuum column 430 and takeup reel 432. Documents such as documents 414 and 416 are transported by means of a document transport system including belts 434.

The document pathway includes print zone 436 between a plurality of hammers 438 and die set 440. Hammers 438 are fixed to encoding apparatus 412, as is die set 440, which is fastened to encoding mechanism 412 by way of screws 442 and base 443.

Documents 414 and 416 are illustrated as being bank checks. Typically, bank checks include pre-printed information along the lower edge thereof in zones 444 and 446 of document 414. A zone 448 is provided for subsequent encoding of such information as the amount of the check. Obviously, the amount of each check is variable, and encoding apparatus 412 encodes the documents 414 and 416 with information concerning the amount of the checks in field 448. Document 416 is shown subsequent to encoding information 450. It will be appreciated that encoding apparatus 412 is specially adapted for depositing variable sequences of characters on discrete documents transported through the apparatus at high speed.

Referring now to FIG. 5, die set 440 includes a series of reverse characters 460 extending from surface 462. Surface 462 is not visible in FIG. 4, but it will be understood that a document entering print zone 436 will first encounter character 464 and last encounter character 466. Thus, index numerals 468 range from "1" to "24" and correspond to the position of the characters on the die set. Thus, for example, the character designated by reference numeral 470 is characterized by the index number "7" because it is the 7th character from character 464. For ease of reference, the index number between "1" and "24" used to describe the position of the character will be referred to as the "Striking Element Number" of that character.

Referring now to FIG. 6, the lower right-hand corner of document 416 includes character sequence 450 as previously described in connection with FIG. 4. A typical number of characters in sequence 450 would be twelve, and the index numbers 484 between "1" and "12" can be used to describe the position of the characters on the document. In sequence 450, the character designated by reference numeral 480 is described by the index number "1" whereas the character designated by reference numeral 482 is described by the index number "12". For ease of reference, the index number between "1" and "12" used to describe a character in sequence 450 shall be referred to as the "Character Position Number" of that character. Sequence 450 itself can be described in terms of the total number of characters in the sequence, in this example twelve, and this number may be referred to as the "String Length". Document 16 includes leading edge 486, which is the first portion of the document to enter print zone 436.

Referring now to FIGS. *7a* and *7b*, ribbon portion 500 includes spent portions 502 separated by a wide portion of unspent ribbon 504. Ribbon portion 500 is illustrative of the ribbon used in the prior art apparatus where the ribbon transport system moved the ribbon only in the forward direction, stopping the ribbon between documents. By way of contrast, ribbon portion 506 includes spent portions 508 separated by relatively narrow unspent portions 510. The width of portions 510 is a matter of design choice and can be eliminated completely if desired.

In operation, documents such as documents 414 and 416 are printed while they are in horizontal motion, known as "on the fly" printing. Documents are transported along the document pathway indicated by arrow 418 through print zone 436, where hammers 438 are sequenced according to control signals to print a desired sequence of characters on the document. By referencing leading edge 486 of the document to the die set and by knowing the document speed as well as the desired character to be printed in each desired character position, through use of a control microprocessor, the desired characters can be printed within allowed tolerances in the desired spaces "on the fly" as the document passes through the print zone.

An unused portion of the ribbon must be present between a hammer and a die character at the instant that the hammer is fired to strike the die. Thus, the ribbon and the document to be printed must move in unison through the print zone. After the last character hammer is fired, in time but not necessarily in position, the ribbon can stop while the document proceeds through the print zone. Because the last hammer in time to fire is usually not the first hammer in position to fire, there is usually a portion of the ribbon left unspent which can be salvaged by backing up the ribbon to a point where only spent ribbon is in the print zone and unspent ribbon begins at the entrance to the print zone.

Bidirectional capability of the ribbon control mechanism is provided by enabling capstan 28 to rotate in either the forward or reverse direction. In the preferred embodiment, a stepper motor is used in conventional fashion to advance and reverse the capstan in a highly controlled fashion. Stepper motors are also used in conventional fashion to drive feed reel 420 and takeup reel 432. Because the ribbon in the print zone is constantly being transported in forward directions as well as variable reverse directions, the operation of the stepper motors which drive feed reel 420 and takeup reel 432 is asynchronous with respect to the stepper motor which drives capstan 428. Conventional MICR ribbon is highly stretchable, so the rapid accelerations required by the ribbon control mechanism are enabled by using vacuum columns 422 and 430. Vacuum columns are known in the art of computer tape control mechanisms, and in conventional fashion vacuum columns 422 and 430 are buffered with photocells. As will be understood by those skilled in the art, the vacuum in vacuum columns 422 and 430 is sufficient to generate sufficient forces on each side of the capstan 428 to move the ribbon in a controlled manner.

The amount of ribbon reversal can be controlled in either of two ways. Since the goal is to reverse the ribbon to the point where no unspent ribbon remains in the print zone, the worst case in terms of amount of unspent ribbon in the print zone would occur when the character on the document Character Position Number "12" (FIG. 6) is struck by the character in the die set at Striking Element Number "24" (FIG. 5). In this worst case, unspent ribbon would fill the print zone for substantially the length of die set 462. Thus, a simple way to control ribbon reversal is merely to assume the worse case each time a document is printed, stop the ribbon transport as the printed field leaves the print zone, and reverse the ribbon an amount substantially equal to the length of the character die set. A disadvantage of this approach is that the ribbon is moved a greater distance in most cases than is actually required, allowing more opportunity for particles to be scraped off which can result in voids in the ink layer or extraneous ink on the documents.

The preferred way to control ribbon reversal is to calculate the precise amount of unspent ribbon remaining in the print zone when the last character in time is struck and driving the capstan in reverse a sufficient amount to leave only spent ribbon in the print zone. Thus, the amount of reversal is a calculated amount based on the printing pattern of the just-printed document. The variable reverse distance can be calculated for each sequence by the following formula:

Reverse Distance = MAX (Striking Element Number + Character Position Number) − String Length, as those terms have been defined above. Thus, for each sequence, the Striking Element Number and Character Position Number for each character to be printed are summed, and the highest sum (MAX) is determined. It will be understood that the sum of the Striking Element Number and Character Position Number determines the chronological sequence in which given characters in a sequence will be struck. The maximum sum of these two numbers is then reduced by the amount of the String Length, and the Reverse Distance remains. Thus, it can be seen that the Reverse Distance is an amount corresponding to the amount of unspent ribbon between the die set and hammers when the last character in time is struck.

A document may have several sequences in which case the ribbon may be reversed for each sequence or any combination of adjacent sequences.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. An encoding apparatus for depositing discrete series of characters on documents transported through the apparatus, comprising:

a document transport mechanism for engaging a document and transporting it through the encoding apparatus along a document pathway;

a die set fixed to the apparatus and having characters extending from a surface thereof along a portion of one side of the document pathway;

a plurality of striking elements fixed to the apparatus in opposing relationship to the characters of the die set on the other side of the document pathway and disposed for striking documents in the document pathway in response to control signals;

a single-strike, ink-bearing ribbon interposed between the striking elements and characters of the die set; drive means selectively transporting a portion of the ribbon along the document pathway either in the same direction and at the same speed as the document transported through the apparatus or in a reverse direction with respect to the document transport direction;

means responsive to the encoding of the chronologically last character in a particular series of characters for determining a length of ribbon to be transported in said reverse direction before a subsequent series of characters is encoded;

means controlling the drive means to stop and reverse the drive means after the chronologically last character in the particular series of characters is encoded a linear distance substantially equal to said determined length, the ribbon being reversed to a ribbon position where encoding of the subsequent series of characters will begin in a portion of the ribbon substantially adjacent to a portion of the ribbon consumed in printing the first series of characters; and said drive controlling means reverses the ribbon a variable reverse distance after printing the particular series of characters on a document, said drive controlling means determining the reverse distance by the formula:

Reverse Distance = MAX (Striking Element Number + Character Position Number) − String Length, where String Length is the total number of characters in the particular series of characters printed, Striking element Number is a number between one and the total number of striking elements used in printing the particular series of characters, and Character Position Number is a number between one and the total number of characters in the particular series of characters.

2. In a printing device for discrete documents continuously moving through said device, where each document passes between at least one fixed character die set on one side of the document and at least one fixed set of striking elements on the other side of the document, the document and a single-strike, ink-bearing ribbon moving through the character die set and striking elements in unison during printing, and the striking elements being sequenced in response to control signals from a control computer to print at least one desired series of characters on the document, the improvement comprising:

drive means for advancing and reversing the ribbon in response to control signals from the control computer;

the control computer including means responsive to the encoding of the chronologically last character in a particular series of characters for determining a length of ribbon to be reversed before a subsequent series of characters is encoded and means for signaling the drive means to reverse the ribbon a linear distance substantially equal to said determined length to position the ribbon for printing in the portion of unspent ribbon substantially adjacent to a portion of spent ribbon; and said control computer activates said drive means to reverse the ribbon a variable distance after printing the particular series of characters on a document, said control computer determining the reverse distance by the formula:

Reverse Distance = MAX (Striking Element Number + Character Position Number) − String Length, where String Length is the total number of characters in the particular series of characters printed, Striking Element Number is a number between one and the total number of striking elements used in printing the particular series of characters, and Character Position Number is a number between one and the total number of characters in the particular series of characters.

* * * * *

UNITED STATES PATENT AND TRADEMARK OFFICE

CERTIFICATE OF CORRECTION

PATENT NO. : 5,181,788

DATED : January 26, 1993

INVENTOR(S) : Thomas J. Norman, Jr., et al.

It is certified that error appears in the above-indentified patent and that said Letters Patent is hereby corrected as shown below:

On the title page, item [73], the Assignee should read --BancTec, Inc.--.

Signed and Sealed this

Second Day of November, 1993

Bruce Lehman

*Attest:*

BRUCE LEHMAN

*Attesting Officer*

*Commissioner of Patents and Trademarks*